US010599099B2

(12) United States Patent
Alagon Carrillo

(10) Patent No.: US 10,599,099 B2
(45) Date of Patent: Mar. 24, 2020

(54) TIMEPIECE MECHANISM

(71) Applicant: Montres Breguet S.A., L'Abbaye (CH)

(72) Inventor: Sebastian Alagon Carrillo, Romainmotier (CH)

(73) Assignee: Montres Breguet S.A., L'Abbaye (CH)

( * ) Notice: Subject to any disclaimer, the term of this patent is extended or adjusted under 35 U.S.C. 154(b) by 190 days.

(21) Appl. No.: 15/968,830

(22) Filed: May 2, 2018

(65) Prior Publication Data

US 2018/0341227 A1 Nov. 29, 2018

(30) Foreign Application Priority Data

May 29, 2017 (EP) ..... 17173323

(51) Int. Cl.
*G04B 19/26* (2006.01)
*G04B 13/00* (2006.01)

(52) U.S. Cl.
CPC ..... *G04B 19/26* (2013.01); *G04B 13/001* (2013.01); *G04B 19/262* (2013.01); *G04B 19/266* (2013.01)

(58) Field of Classification Search
CPC .. G04B 13/001; G04B 19/262; G04B 19/266; G04B 19/26
See application file for complete search history.

(56) References Cited

U.S. PATENT DOCUMENTS 3,316,706 A 5/1967 Kilburg
7,359,289 B2 * 4/2008 Saunier ..... G04B 3/008 368/229
9,207,642 B2 * 12/2015 Willemin ..... G04B 19/262
(Continued)

FOREIGN PATENT DOCUMENTS

WO WO 2016/029296 A1 3/2016

OTHER PUBLICATIONS

European Search Report dated Nov. 8, 2017 in European Application 17173323.1 filed on May 29, 2017 (with English Translation of Categories of Cited Documents).

*Primary Examiner* — Sean Kayes
(74) *Attorney, Agent, or Firm* — Oblon, McClelland, Maier & Neustadt, L.L.P.

(57) ABSTRACT

The present invention proposes a timepiece mechanism comprising:

a lever, rotatable about a lever axis, the angular position of the lever representing a first value, wherein a zero value of the first value corresponds to a reference direction, a sliding block mounted to move in translation on the lever in a direction substantially perpendicular to the axis of the lever and comprising a guide-mark element whose trajectory in translation relative to the lever is secant to the lever axis, the radial position of the guide-mark element with respect to the lever axis representing a second value, an output device formed of a deformable parallelogram in a plane perpendicular to the lever axis, the parallelogram including a first side, which is stationary with reference to the lever axis and perpendicular to the reference direction, a second side, which is opposite to the first side and linked in translation to the guide-mark element in the direction perpendicular to the reference direction, the angular position of the third and fourth sides of the parallelogram, which are adjacent to the first side, being substantially proportional to the product of the first and second values.

11 Claims, 3 Drawing Sheets

(56) References Cited

U.S. PATENT DOCUMENTS

| | | | | |
|---|---|---|---|---|
| 9,335,739 | B2 * | 5/2016 | Gilomen | G04B 19/26 |
| 9,535,402 | B2 * | 1/2017 | Gilomen | G04B 19/22 |
| 2015/0234357 | A1 * | 8/2015 | Willemin | G04B 19/262<br>368/17 |

* cited by examiner

TIMEPIECE MECHANISM

This application claims priority from European patent application No. 17173323.1 filed on May 29, 2017, the entire disclosure of which is hereby incorporated herein by reference.

FIELD OF THE INVENTION

The present invention relates to the field of horology. It more particularly concerns a timepiece mechanism capable of performing a mathematical operation.

BACKGROUND OF THE INVENTION

Certain events are dependent on the convergence of at least two natural phenomena having distinct periods that are not multiples of one another. Sunrise and sunset times, which depend, at a given point, on the time and date or on tide times and tidal coefficients, which depend, in addition, on the position of the moon, can be mentioned as examples. Representing such events by using exclusively mechanical means presents some difficulty.

A first mechanical solution for representing an event that depends on two-time functions, could consist in using a three-dimensional cam. The three-dimensional cam may, for example, be independently movable in the two degrees of freedom of a sliding pivot. The feeler moves in reference to the cam surface, in rotation about the pivot axis and in translation along the axis, each of the two movements being determined independently according to the two time functions. However, this type of solution is unsuitable for incorporation into a timepiece mechanism due to the excessive space occupied by the three-dimensional cam.

WO Patent Application No 2016/029296 proposes performing various mathematical operations, including multiplication, but without detailing the embodiment that allows this object to be achieved.

SUMMARY OF THE INVENTION

It is an object of the present invention to overcome the drawbacks of the prior art by proposing a multiplier mechanism which is easier to incorporate into a watch.

More precisely, the invention concerns a timepiece mechanism comprising a first lever, rotatable about a lever axis, the angular position of the first lever representing a first value, wherein a zero value of the first value corresponds to a reference direction. The mechanism also comprises a sliding block mounted to move in translation on the first lever in a direction substantially perpendicular to the lever axis, the sliding block comprising a guide-mark element whose trajectory in translation relative to the first lever is secant to the lever axis, the radial position of the guide-mark element with respect to the lever axis representing a second value. The mechanism further comprises an output device formed of deformable parallelogram in a plane perpendicular to the lever axis, the parallelogram including a first side, which is stationary with respect to the lever axis and perpendicular to the reference direction, a second side, which is opposite to the first side and linked in translation to the guide-mark element in the direction perpendicular to the reference direction.

This arrangement allows to perform a multiplication operation, since the angular position of the third and fourth sides of the parallelogram, which are adjacent to the first side, are substantially proportional to the product of the first and second values.

According to an advantageous embodiment of the invention, the first and second values are time values.

According to another advantageous embodiment of the invention, the first lever is angularly positioned by a first wheel set intended to be kinematically connected to a timepiece movement.

According to another advantageous embodiment, the first wheel set is a first cam arranged to cooperate with a cam follower integral with the first lever and the mechanism comprises an elastic return means holding the cam follower in contact with the first cam.

According to another advantageous embodiment, the sliding block comprises a rack extending in the direction of translation and the mechanism comprises a pinion coaxial to the lever axis and meshed with the rack, the pinion also meshing with a second wheel set intended to be kinematically connected to a timepiece movement.

According to another advantageous embodiment, the second wheel set is a second lever angularly positioned by a second cam intended to be kinematically connected to a timepiece movement.

According to another advantageous embodiment, the guide-mark element is a pin which is at least partially housed inside an oblong opening comprised in the second side of the deformable parallelogram, the oblong opening extending in the reference direction.

According to another advantageous embodiment, the radius of the pinion is preferably ten times smaller than the length of the oblong opening, ideally twenty times smaller.

According to another advantageous embodiment, the angular position of the first lever is comprised within a range $[-\pi/4, +\pi/4]$, and preferably within a range $[-\pi/8, +\pi/8]$.

BRIEF DESCRIPTION OF THE DRAWINGS

Other details of the invention will appear more clearly upon reading the following description, made with reference to the annexed drawings, in which.

DETAILED DESCRIPTION OF A PREFERRED EMBODIMENT

Figure 1:
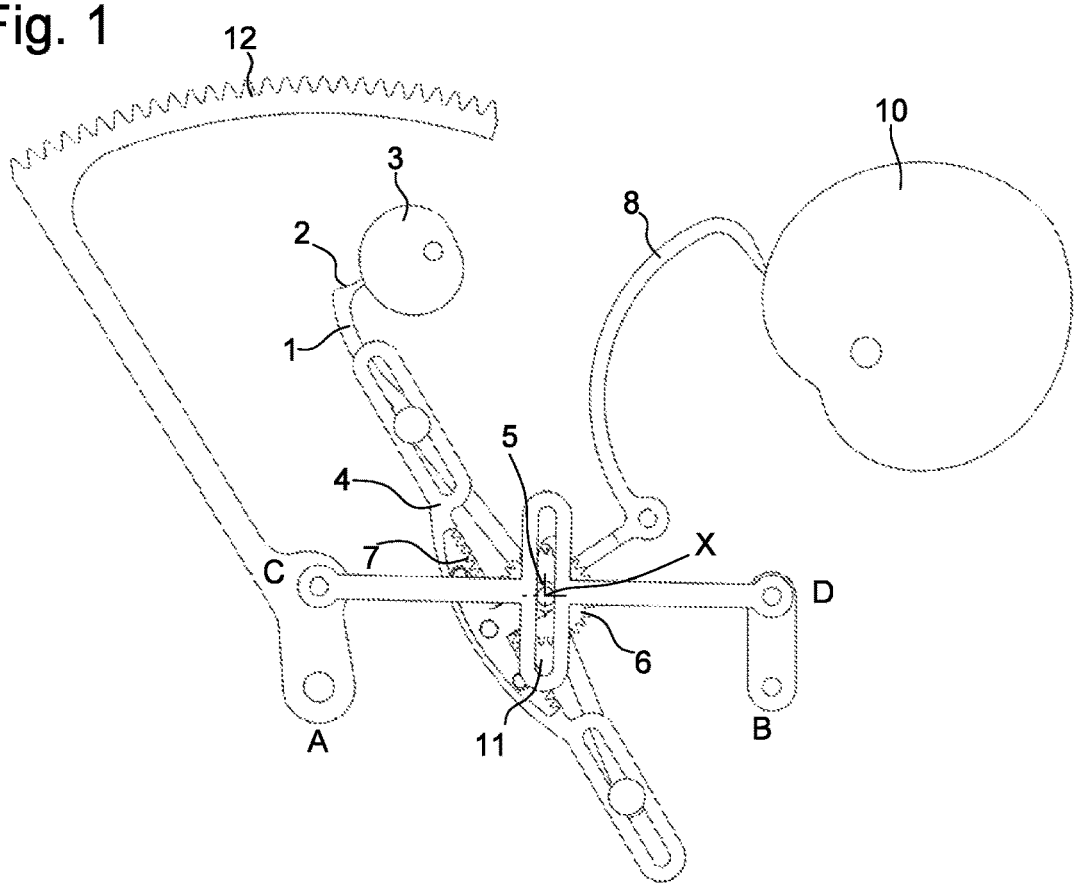
FIG. 1 represent a view of the multiplier mechanism, with the second input value at zero.

FIG. 1 represents a multiplier mechanism according to the invention, intended to be incorporated in a movement or to be added in a modular manner to a movement. This timepiece mechanism comprises two input wheel sets and one output wheel set, the position of the output wheel set representing a value proportional to the product of the values represented by the positions of the two input wheel sets. To perform the multiplication function, the mechanism comprises a first lever 1, rotatable about a lever axis X, lever axis X being perpendicular to the movement. Lever 1 is angularly positioned by a first wheel set intended to be kinematically connected to a timepiece movement. In the embodiment shown, the first wheel set is a first cam 3 intended to be driven in rotation by the timepiece movement. The mechanism comprises a return means (not represented), arranged to hold a feeler 2, integral with lever 1, in contact with first cam 3. The angular position of lever 1 about its lever axis X corresponds to a first value which may be positive or negative. A zero value of the first value corresponds to a reference direction for lever 1. Alternatively, the first wheel set could be a pinion meshing with a toothed sector integral with lever 1 and centred on lever axis X.

A sliding block 4 is slidably mounted on lever 1 in a plane substantially perpendicular to lever axis X. Sliding block 4 is movable in translation relative to lever 1 and follows lever 1 in its rotational motions about axis X. A guide-mark element, integral with sliding block 4, is disposed such that its trajectory in translation relative to lever 1, is secant to lever axis X. In the embodiment shown, the guide-mark element takes the form of a pin 5. In FIG. 1, pin 5 is represented in a particular position, collinear to lever axis X. The angular position of lever 1 is that of the sliding guide axis of sliding block 4.

A pinion 6, pivotally mounted on lever axis X, is meshed with a rack 7 comprised in sliding block 4. Since pinion 6 is coaxial with lever 1, it remains meshed with rack 7 whatever the angular position of lever 1. It may be noted that the distance from the guide-mark element to rack 7 is equal to the radius of pinion 6. Pinion 6 also meshes with a second wheel set intended to be kinematically connected to a timepiece movement.

In the embodiment presented, the second wheel set is a second lever or an oscillating arm 8 comprising a toothed sector 9 meshed with pinion 6. Oscillating arm 8 is angularly positioned by a second cam 10 intended to be connected to a timepiece movement. The position of second cam 10 determines the position of oscillating arm 8, that of pinion 6 and consequently the radial position of sliding block 4 and thus of the guide-mark element formed by pin 5, relative to lever axis X. The radial position of pin 5 with respect to lever axis X corresponds to a second value which may be positive or negative. In the position represented in FIG. 1, pin 5 is collinear with lever axis X, which corresponds to a zero value of the second value.

The multiplier mechanism also comprises an output device formed of a deformable parallelogram located in a plane perpendicular to lever axis X. The deformable parallelogram includes a first side AB, which is stationary with reference to lever axis X and perpendicular to the reference direction, a second side CD, which is opposite to first side AB and linked in translation to pin 5 in the direction perpendicular to the reference direction. To this end, the second side includes an oblong opening 11 extending in the reference direction, i.e. perpendicular to first side AB and second side CD of the parallelogram. Pin 5 is at least partially housed inside oblong opening 11 whose width is substantially equal to the diameter of pin 5.

Figure 2:
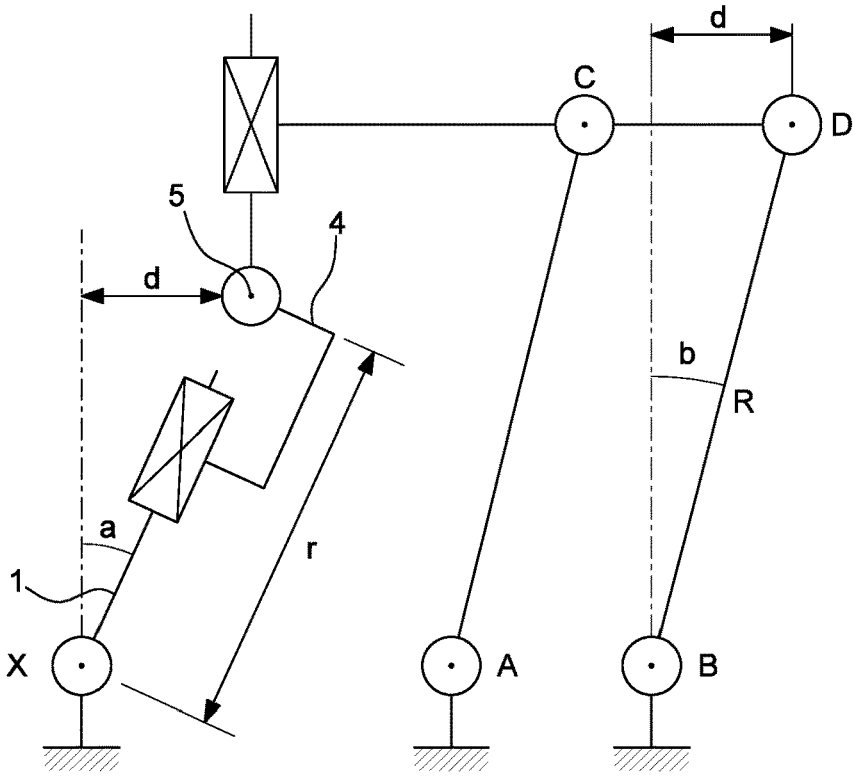
FIG. 2 represents a kinematic diagram of the mechanism.

FIG. 2 shows a kinematic diagram of the mechanism of the invention. Lever 1 is represented with an angle of inclination a between the direction of the sliding guide link of sliding block 4 and the reference direction, which is the vertical direction here. Angle a is proportional to the first value. Pin 5 is located at a radial distance r from lever axis X, representing the second value. The lateral movement d of pin 5 in the horizontal direction perpendicular to the reference direction is given by the formula:

$$d=r\cdot\sin(a)$$

Since pin 5 is kinematically linked in translation in the horizontal direction to second side CD, points C and D also move by a value d in the direction perpendicular to the angular reference direction. If R is the length of the adjacent sides AC and BD of the parallelogram, the angular position b of the adjacent sides with respect to the reference direction is obtained from the formula:

$$d=R\cdot\sin(b)$$

Whatever the range of first values represented by the angular position of the lever, angle a can be chosen to be proportional to the first value so as to remain within a range $[-\pi/4, +\pi/4]$, and preferably within a range $[-\pi/8, +\pi/8]$, wherein the sine of angle a can be approximated by the value of angle a. Likewise, it is possible to construct the mechanism so that angle b remains more closed than angle a, i.e. so that distance r does not exceed length R of the adjacent sides of the parallelogram. Replacing the sines with their respective angles, one obtains:

$$b=a\cdot r/R$$

In other words, the angular position of the adjacent sides given by angle b is proportional to the product a·r of the first and second values.

The output value determined by the angular position of the third AC and fourth BD sides of the parallelogram, which are adjacent to first side AB, can be directly obtained by means of a display hand integral with one of the lateral sides of the deformable parallelogram, or indirectly by means of a toothed sector 12 driving a pinion or a rack. The output of the multiplier mechanism can also be kinematically connected to the input of another multiplier mechanism to perform multiplication of a number of values higher than two. It is also possible to perform operations with powers by multiplying a value by itself several times.

Figure 3:
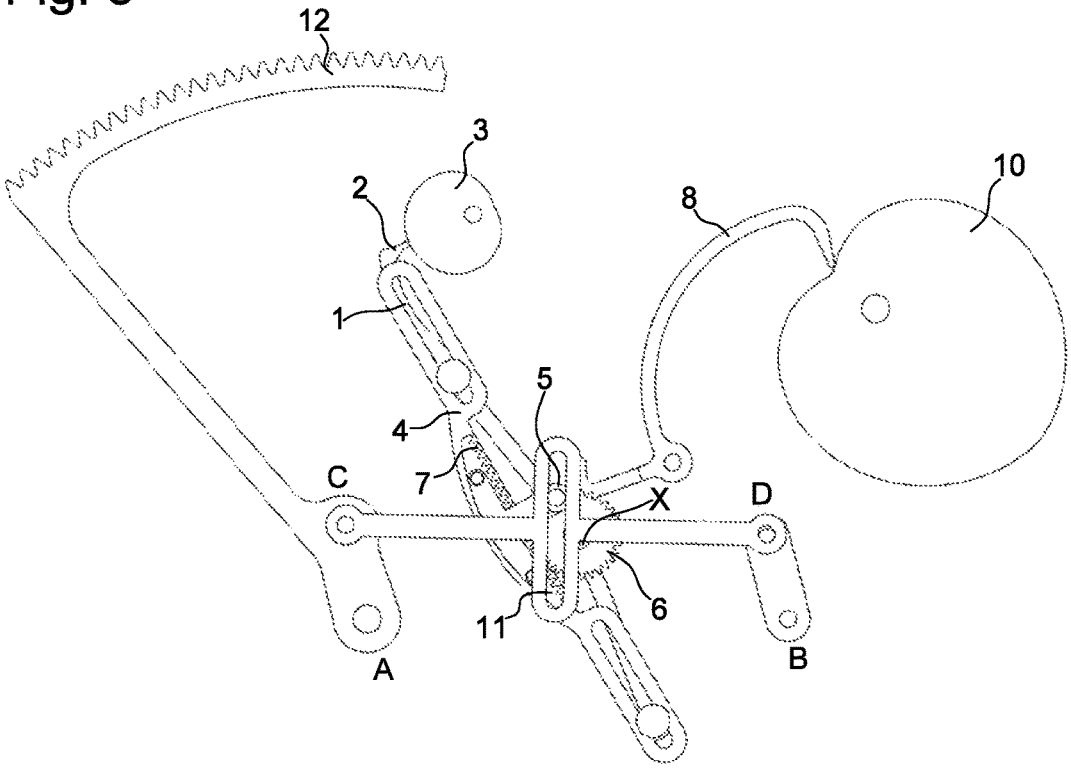
FIGS. 3 to 6 represent the mechanism in different positions.
Figure 4:
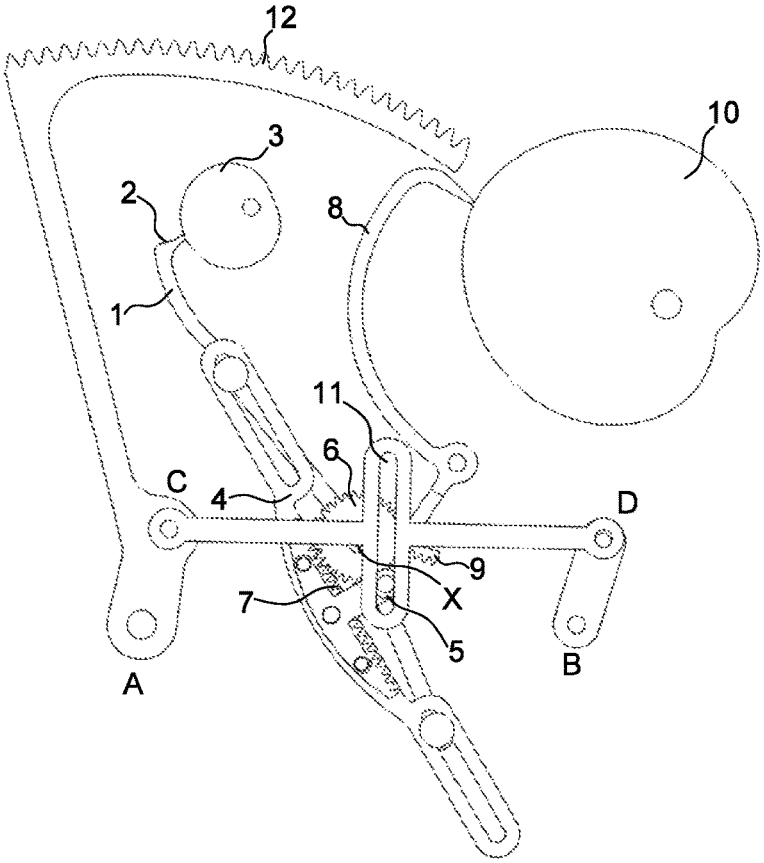
Figure 5:
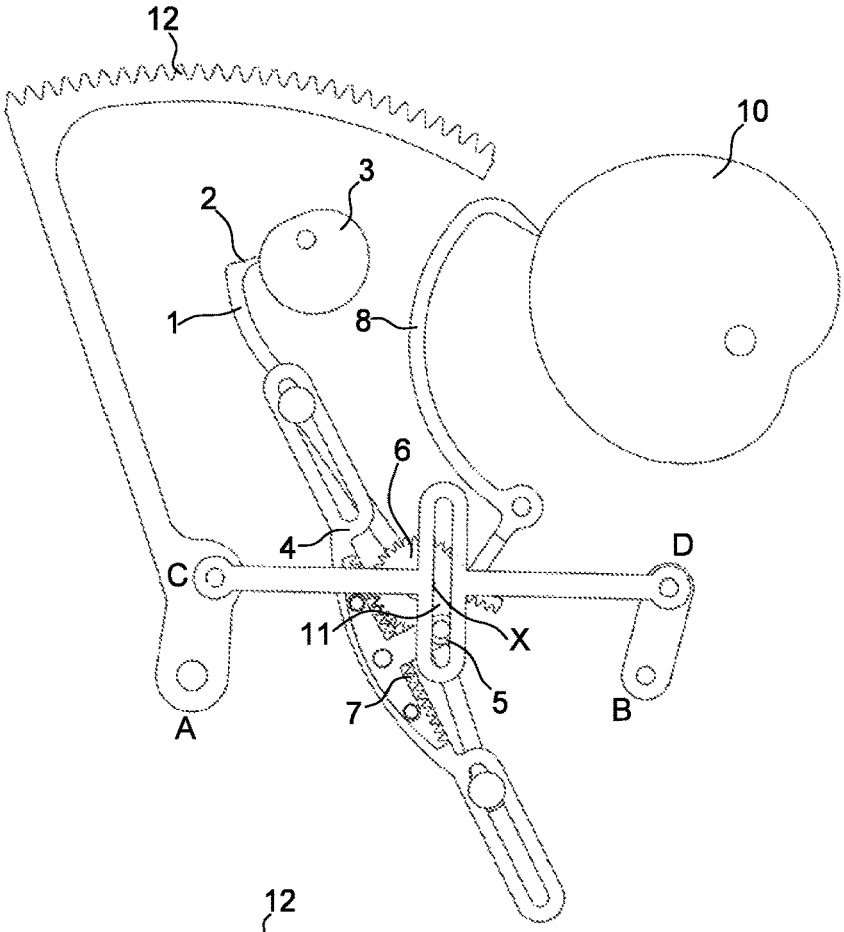
Figure 6:
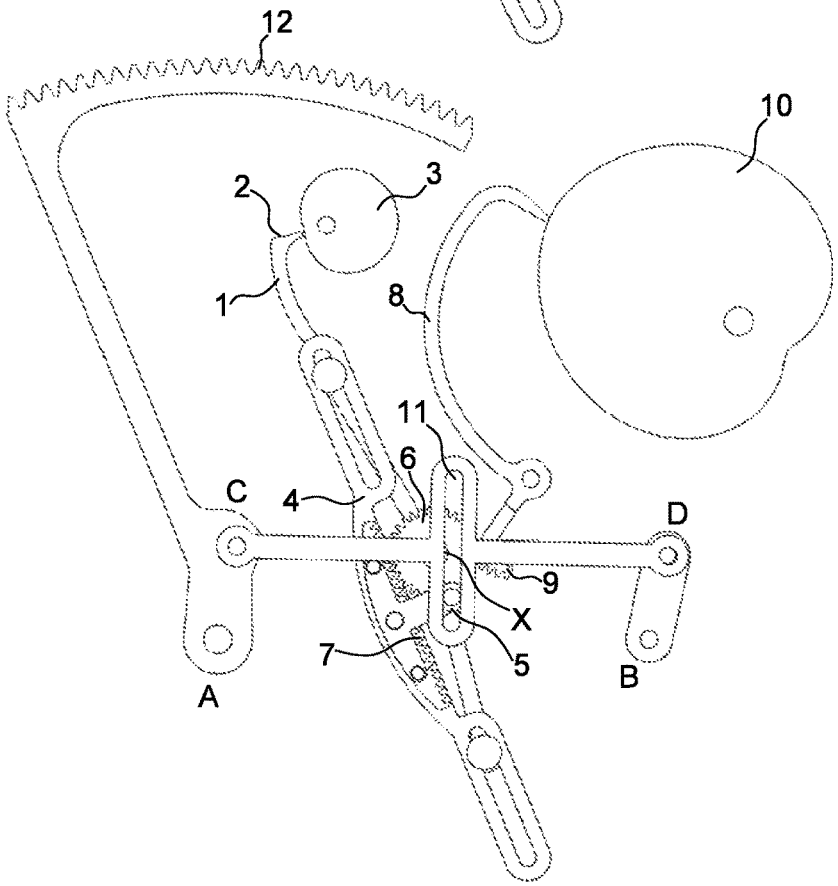

FIGS. 3 to 4 represent the mechanism in different positions according to variation of the second value, which results in movement of sliding block 4. FIGS. 5 and 6 represent the mechanism in which lever 1 pivots according to variation of the first value.

In the proposed embodiment, it was seen that the radial movement of sliding block 4 was obtained by the rotation of pinion 6 meshing with rack 7. When the first value varies, causing a rotation of lever 1 about lever axis X, rack 7 rolls over pinion 6 causing an undesired movement of sliding block 4 with respect to lever 1, which will change the radial position of pin 5 representing the second value. To limit this effect, the radius of pinion 6 will be chosen to be as small as possible, preferably ten times smaller than the length of the oblong opening representing the maximum travel of the sliding block, ideally it will be chosen to be 20 times smaller than this length. Even if the radius of pinion 6 is reduced, the problem remains noticeable when the second value is close to zero, as is the case in FIG. 1. This is why, if one of the two values to be multiplied varies but without becoming zero, it will preferably be assigned as the second value that determines the radial movement of sliding block 4 with respect to lever 1. Thus, the effect of the position of lever 1 on the position of sliding block 4 will be reduced.

The mechanism proposed by the invention thus allows to perform a multiplication operation between two independent input values. The essentially flat arrangement of the mechanism allows it to be easily incorporated in a movement or added in an independent module.

The input values may be periodic time functions having very different periods, such as, for example, the Earth's axial tilt, the time of day, the lunar month, etc. The operations to multiply this data made possible by the mechanism of the invention allow a representation or an indication of various natural phenomena to be obtained, such as the display of the Earth's terminator, calculation of sunrise and sunset times, and calculation of tide times and tidal coefficients.

What is claimed is:

1. A timepiece mechanism, wherein the mechanism comprises:

a first lever, rotatable about a lever axis, the angular position of the first lever representing a first value a, wherein a zero value of the first value corresponds to a reference direction, a sliding block mounted to move in translation on the first lever in a direction substantially perpendicular to the axis of the first lever and comprising a guide-mark element whose trajectory in translation relative to the first lever is secant to the lever axis, the radial position of the guide-mark element with respect to the lever axis representing a second value b, an output device formed of a deformable parallelogram in a plane perpendicular to the lever axis, the parallelogram including a first side that is stationary relative to the lever axis and perpendicular to the reference direction, a second side opposite to the first side and linked in translation to the guide-mark element in the direction perpendicular to the reference direction, and wherein the angular position of the third side and the fourth side of the parallelogram, which are adjacent to the first side, satisfies the equation:

$$r\cdot\sin(a)=R\cdot\sin(b)$$

where r is the radial distance of the guide-mark element from the lever axis and R is the length of the third side and the fourth side of the parallelogram.

2. The timepiece mechanism according to claim 1, wherein the guide-mark element is a pin at least partially housed inside an oblong opening comprised in the second side of the deformable parallelogram, the oblong opening extending in the reference direction.

3. The timepiece movement according to claim 1, wherein the first value and the second value are time functions.

4. The timepiece mechanism according to claim 1, wherein the first lever is angularly positioned by a first wheel set intended to be kinematically connected to a timepiece movement.

5. The timepiece mechanism according to claim 4, wherein the first wheel set is a first cam arranged to cooperate with a cam follower integral with the first lever and wherein the mechanism comprises an elastic return means holding the cam follower in contact with the first cam.

6. The timepiece mechanism according to claim 1, wherein the sliding block comprises a rack extending in the direction of translation and wherein the mechanism comprises a pinion coaxial to the axis of the first lever and meshed with the rack, the pinion also meshing with a second wheel set intended to be kinematically connected to a timepiece movement.

7. The timepiece mechanism according to claim 6, wherein the second wheel set is a second lever angularly positioned by a second cam intended to be kinematically connected to a timepiece movement.

8. The timepiece mechanism according to claim 6, wherein the guide-mark element is a pin at least partially housed inside an oblong opening comprised in the second side of the deformable parallelogram, the oblong opening extending in the reference direction, and wherein the radius of the pinion is ten times smaller than the length of the oblong opening.

9. The timepiece mechanism according to claim 8, wherein the radius of the pinion is twenty times smaller than the length of the oblong opening.

10. The timepiece mechanism according to claim 1, wherein the angular position of the first lever is comprised within a range $[-\pi/4, +\pi/4]$.

11. The timepiece mechanism according to claim 10, wherein the angular position of the first lever is comprised within a range $[-\pi/8, +\pi/8]$.

* * * * *